United States Patent [19]

Crisci

[11] 4,166,548

[45] Sep. 4, 1979

[54] CONTAINERS AND CLOSURES THEREFOR

[75] Inventor: Victor E. Crisci, Wellsburg, W. Va.

[73] Assignee: Polysar Resins, Inc., Leominster, Mass.

[21] Appl. No.: 910,535

[22] Filed: May 30, 1978

[51] Int. Cl.[2] ..... B65D 39/00

[52] U.S. Cl. ..... 220/308; 220/284

[58] Field of Search ..... 220/284, 306, 308; 206/508

[56] References Cited

U.S. PATENT DOCUMENTS

| | | | |
|---|---|---|---|
| 3,516,571 | 6/1970 | Roper et al. | 220/308 |
| 3,811,597 | 5/1974 | Frankenberg et al. | 220/284 |

*Primary Examiner*—George T. Hall

*Attorney, Agent, or Firm*—Stevens, Davis, Miller & Mosher

[57] ABSTRACT

In a container and closure assembly, there is a resilient seal between the two components and the resiliency of the seal determines the normal relative closed positions of the closure and container. When the assembly is included within a stack, there is movement of the closure in the closing direction further to compress the seal. To prevent over-compression of the seal, opposed movement limiting surfaces are provided upon the closure and container, these surfaces being slightly spaced normally, but closing together to take loads directly from closure to container and thus avoid overloading the seal, when the assembly is located in a stack.

5 Claims, 6 Drawing Figures

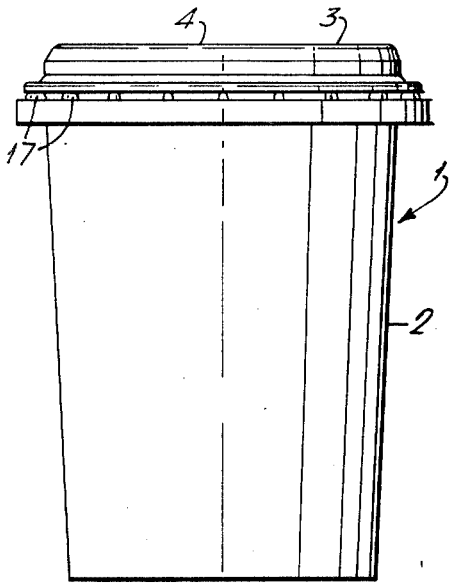
Fig. 1.
Fig. 3.
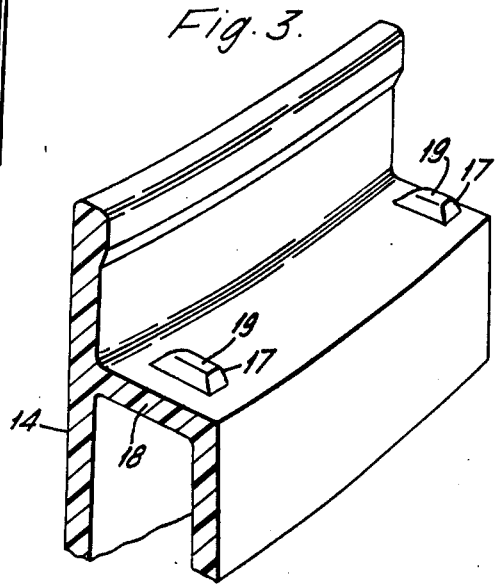
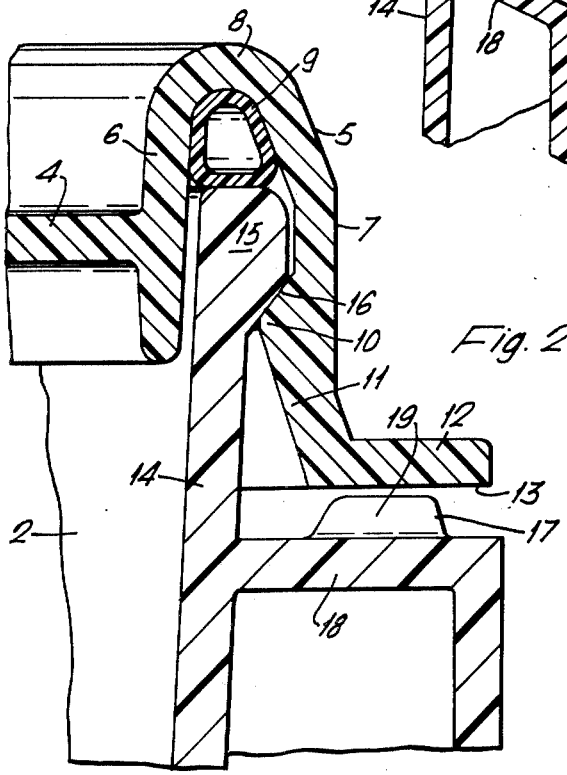
Fig. 2.

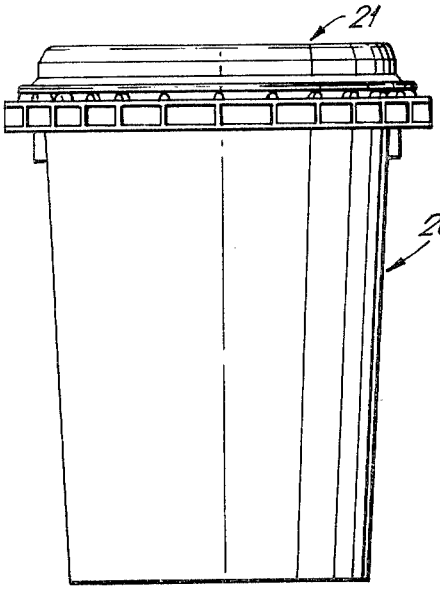
Fig. 4.
Fig. 5.
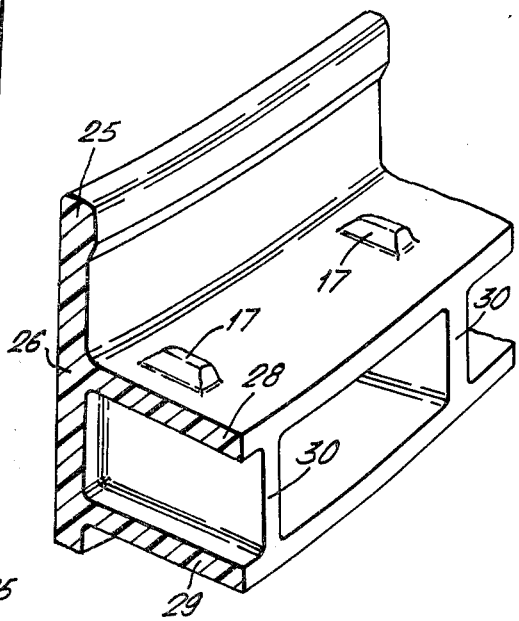
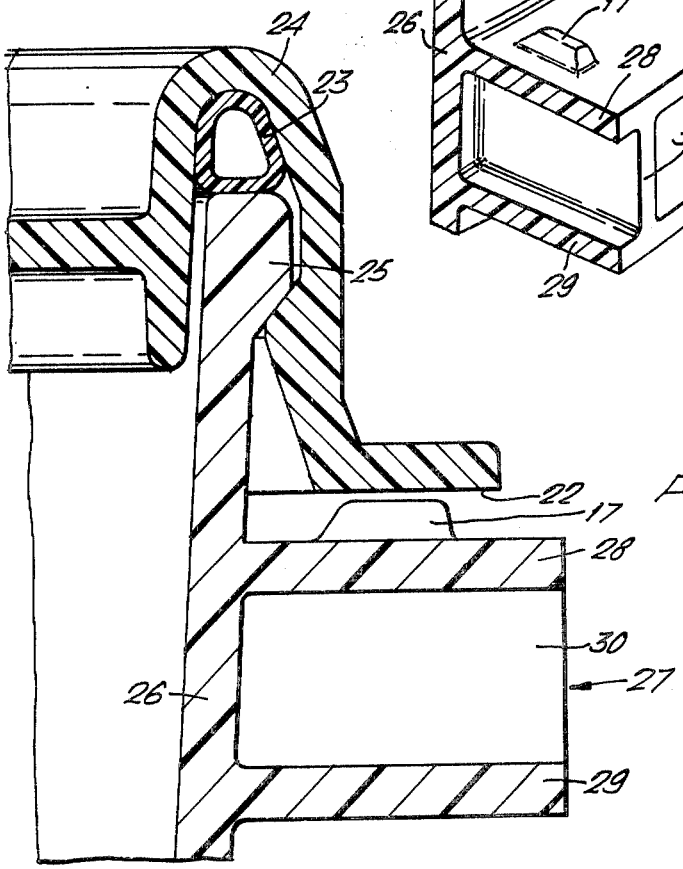
Fig. 6.

CONTAINERS AND CLOSURES THEREFOR

This invention relates to containers and closures therefor and is concerned particularly with the seating of closures upon container rims and the sealing effect provided between closures and the rims.

In closure and container constructions in which effective sealing between the two compartments is of utmost importance, separate annular seals may be provided, these seals either being detachable from the closure or container or being secured in position by adhesive. To attain a positive seal and positive seat between conventional containers and their closures while preventing movement of the closures upon the containers, it is necessary fully to compress the seals by the closure force between the two components. However, after the full closure force has been applied for a period of time, mechanical hysteresis takes effect and a seal tends to become set in its compressed state thereby reducing the resilient reactive force applied against the container so that the sealing effect is at least partially destroyed. Further, although a seal may be sealing efficiently, it may have set at least partly towards its compressed state in which it is faithfully shaped complimentarily to any imperfections against a container or closure seat. In such a case, once the closure has been removed, because it may never be possible for it to be replaced in exactly the same circumferential position upon its container, leakage may take place. Also, when such containers and closures are filled with stored material and are stacked on top of each other, the weight upon the lower containers is such as to increase compression of the seals. In this event, once the weight has been removed from the lower containers, there is an increased likelihood of leakage around the seals of these containers because any relaxation of pressure of a closure upon its container may not necessarily be accompanied by a relaxation of the seals.

It may be thought possible that containers and closures could be designed in such a way that the compressive force applied to seals is reduced thereby reducing the possibility of the seals becoming set once they have been compressed so as to resist any tendency for there to be a leakage path developing around the seals. However, it is a little difficult to design constructions in which seals are not fully compressed without resulting in an assembly in which there is less positive attachment of closures to containers and resultant sloppiness of fit which is not a desirable characteristic of containers, especially those of large capacity.

It is an aspect of the present invention, however, that a resilient seal is compressible axially between the rim of a container and an annular rim portion of a closure, the seal having a resiliency and determining the normal relative closed positions of the closure and container so that the seal is further compressible under pressure applied to the closure, the inventive step being the provision of axially opposed movement limiting surfaces upon the closure and container. When the closure is subjected to an increase in pressure as by a second container and closure being placed on top, then the closure and container move further in their closing direction until the axially opposed limiting surfaces engage one another so as to stop movement in the closing direction and, therefore, prevent any additional compression of the seal.

The movement limiting surfaces may be of any convenient construction and which will coact together to provide the advantage that additional compression of the seal is prevented. However, in preferred practical constructions it is envisaged that the container should have at least one rib which lies outwardly from the side wall of the container and this rib extends in an axial direction towards the closure i.e. it points in an upward direction and the surface of the closure is disposed in axial alignment with the rib so as to engage it. It is envisaged that a space between the closure and the rib or other movement limiting surface may be possibly up to 0.020 inches but it is preferred that the distance should be no greater than 0.010 inches. Clearly, if the full sealing effect is to be created while ensuring that the closure is not bedded completely down onto the container in a normal position of the closure upon the container, then provision must be made to provide a space between the opposing surfaces in this position of the closure. A distance of a few thousandths of an inch between the opposing surfaces in the normal position of the closure should suffice, e.g. a gap of around 0.008 inches should be considered as a minimum distance between the surfaces.

It is also to be preferred that the closure is spaced from another axially facing surface of the container when the opposing movement limiting surfaces lie in engagement and that the space so provided is accessible from outside the container for a tool to be inserted therein for the purpose of prizing the closure from the container. In a practical way of putting such a construction into effect, the side wall of the container is formed with a shoulder standing radially outwards from the side wall, and the rib or ribs extend axially from the shoulder towards the container rim whereby when the closure engages the top of the rib or ribs it is spaced from the shoulder to enable a prizing tool to be inserted between the shoulder and closure.

Embodiments of the invention will now be described by way of example with reference to the accompanying drawings in which:

FIG. 1 is a side elevational view of a container and closure assembly according to a first embodiment;

FIG. 2 is a cross-sectional view along the axis of the assembly showing part of the assembly on a larger scale than that shown in FIG. 1;

FIG. 3 is an isometric view of part of the container shown in FIG. 2;

FIG. 4 is a side elevational view of a container and closure assembly according to a second embodiment;

FIG. 5 is an isometric view of part of the container of FIG. 4 but on a larger scale; and FIG. 6 is a cross-sectional view along the axis of the assembly and showing part of the assembly.

As shown in FIG. 1, in a first embodiment a 2 gallon container and closure assembly generally shown by numeral 1 includes a container 2 and closure 3 both moulded from high density polyethylene although other suitable mouldable plastics materials, e.g. polypropylene, may be used. The closure 3 comprises a container cover portion 4 which is surrounded by an annular rim portion 5. The rim portion 5 is of inverted U-shape having an annular inner wall 6 spaced around which is an outer annular wall 7, the two walls being joined together at their base 8. Lying within the U-shaped rim at the base is a resilient O-ring seal 9 made of elastomeric material. The outer wall 7 extends downwardly and part way down its length is provided with a locking means in the form of a radially inwards projection 10. Below the projection 10, the outer wall 7 is splayed outwards slightly at 11 and terminates in a planar annular foot or flange 12. The flange 12 has a lower planar surface 13.

The container 2 has a side wall 14 which is of frustoconical form and having at its wider upper end a rim 15 which is approximately 9 inches in diameter and has a locking means in the form of a downwardly depending shoulder 16 which is engaged by the projection 10 to hold the container and closure assembled together. The seal 9 is trapped between the rim 15 of the container and the base 8 of the U-shaped rim portion of the closure and the resilient nature of the seal normally holds the container and closure together with the shoulder 16 engaged by the projection 10 as shown in FIG. 2. There is, therefore, no means provided for positive engagement of the closure and container together in their closing direction upon assembly so that if a loaded container of similar construction is placed on top of the assembly in stacking relationship during storage, this immediately means that the seal 9 will be compressed further as the closure is moved downwards onto the container so as to disengage the projection from the shoulder 16. To prevent the over-engagement of closure and container going beyond specified and desirable limits such that undue distortion of the seal 9 would take place, a means is provided for preventing over-engagement of the closure and container. This means which comprises the lower surface 13 of the flange 12 also includes a plurality of radially extending circumferentially spaced-apart ribs 17 which extend outwards from and are spaced from the side wall of the container. The ribs which are spaced about 2 inches apart also extend upwardly from an annular shoulder 18 which projects outwardly from the side wall. Each rib is of rectangular cross-section and tapers upwardly to a horizontal surface 19 which is about ½" wide and opposes the surface 13 of the flange 12 while being spaced slightly below it in the normal position of the closure and container, i.e. when the shoulder 16 is engaged by the projection 10. In this condition of the parts of the assembly, the distance between the surfaces 13 and 19 is preferably of the order of between 0.008 and 0.010 inches.

In use of the above construction, when the container is filled with a product and the closure is placed on top, the resilient seal 9 effectively seals between the parts while holding the projection 10 in engagement with the shoulder 16. Should the container be placed in a stack of stored containers with a container or containers located on top of the closure 3, then a force is applied to the closure which has the effect of resiliently loading the seal 9 so as to force the closure further downwards onto the container, i.e. in the closing direction. Clearly, such force would have the effect of compressing the seal 9 possibly to its limits without the use of the annular flange 12 and the ribs 17. However, after the closure has moved by up to 0.10 inches in the example, the surface 13 engages the surfaces 19 of the ribs so as to prevent any further downward movement of the closure and the weight of the stack of containers above the assembly is carried through the closure and down the container side wall.

It is clear, therefore, from the above that the seal 9 even under loaded conditions is not distorted to any substantial extent beyond its normal closed position as shown in FIG. 2. This means that should the assembly be removed from the stack, then the seal should not have set unduly in position and will still seal effectively between the container rim and the base of the U-shaped rim portion of the closure.

In contrast to this, in a situation in which no opposing movement limiting surfaces are provided, i.e. a construction not coming within the scope of the invention, it could be found that the seal 9 would be compressed to such an extent that after a period of time in loading condition the elastomeric material had become set so that when the closure and container return to their relative normal position, a gap or gaps would develop around the seal thus allowing for contamination or leakage of the contained product.

Apart from the fact that the above described construction allows for a sealing action to take place which is permanent even after the assembly has been removed from a loaded stack of containers, the assembly is also constructed so as to enable the closure to be removed from the container fairly simply. While minimum gap requirements are provided between the surfaces 13 and 19, the use of the shoulder 18 spaced from the surface 13 provides a gap between spaced-apart ribs into which a prizing tool such as a screwdriver or opening bar may be inserted.

In a second embodiment having all the advantages discussed above for the first embodiment, a 5-gallon container and closure assembly as shown in FIG. 4 comprises a container 20 and closure 21.

As is shown by FIGS. 5 and 6, the container 20 has ribs 17 which serve to prevent the closure from moving downwardly beyond a limit determined by the engagement of an undersurface 22 of the closure with the ribs when similar and filled containers are in a stacked condition. As described for the first embodiment, therefore, this prevents undue compression of a compressible O-ring seal 23 which lies between the base of a U-shaped rim 24 of the closure and a rim 25 of the container.

For the purpose of preventing undue distortion of the side wall 26 of the container under the load imposed upon it by stacked containers above it, a side wall reinforcement 27 carries the ribs 17. This reinforcement also ensures the loads upon the container are dissipated into the side wall without the build-up of any undue stress conditions which could lead to splitting of the plastic material forming the side wall. The reinforcement comprises two annular planar flanges 28 and 29 which extend radially outwards from the side wall 26 in slightly spaced apart relationship and these two flanges are integrally joined together, not only by the side wall itself, but also by a plurality of circumferentially spaced, radially and axially extending walls 30 which make the reinforcement into a box construction which is open-sided, i.e. is open in the radial direction. The upper flange 28 is integrally formed with the upstanding ribs 17 which are preferably positioned directly above the walls 30 as shown in FIG. 5. The relative dimensions and relative positioning of the walls 30 and flanges 28 and 29 are subject to design considerations and are not considered to be limitations necessary to the box section reinforcement. In the 5-gallon container being described the walls 30 lie about 1" apart around the container and the flanges 28 and 29 are approximately ½ inch apart with the thickness of walls and flanges being about 0.090 inches.

In use of the 5-gallon container and closure assembly when it is stacked in filled condition with other containers above it, the seal 23 is compressed until the closure undersurface engages the ribs 17. Thereafter, substantially no further compression of the seal 23 takes place and the stacking load is taken through the ribs 17 and into the side wall 26 through the reinforcement 27. If the stacking load is particularly excessive, the reinforcement 27, because of its box construction, resists any tendency to twist upon the side wall so that virtually no distortion of the side wall takes place and side wall splitting or cracking is avoided.

It will, of course, be realized that ribs may be provided upon the closure instead of upon the container. In a practical construction, i.e. a modification of the second embodiment (not shown), ribs 17 would be omitted from the flange 28 and ribs would extend downwardly from the undersurface 22 of the closure with which they would be integral. In the modification, the closure ribs would normally be spaced from the flange 28 but would engage the flange during downward movement of the closure so as to prevent overengagement of container and closure.

What is claimed is:

1. A container and closure assembly comprising a closure provided with a container closure portion surrounded by an annular rim portion, the rim portion including a downwardly depending annular flange and the container comprising a side wall terminating at its upper end in a rim, the closure being closed upon the container rim and the rim and rim portion having mutually engaged locking means retaining the closure upon the rim, the rim and rim portion axially compressing between them a resilient seal, the resiliency of which determines normal relative closed positions of the closure and container, and the closure being moveable under downward external pressure from the normal closed position further in the closing direction relative to the container so as to increase axial compression upon the seal, the closure and container mutually comprising an axially facing surface and a surface opposing the axially facing surface, the axially facing surface having a plurality of circumferentially spaced-apart ribs projecting axially therefrom and towards the opposing surface, the ribs being spaced from the opposing surface in the normal closed position of container and closure, movement of the closure in the closing direction causing the ribs and the opposing surface to engage one another to terminate said movement with gaps being formed between the axially facing and opposing surfaces at positions between the ribs into which a prizing tool may be inserted for removal of the closure from the container.

2. An assembly according to claim 1 wherein the container has a radially outward shoulder with an upper surface and the ribs extend upwardly from the shoulder, movement of the closure in the closing direction causing the ribs to be engaged by the opposing surface which is provided by the closure, the gaps being formed between the shoulder and the closure.

3. An assembly according to claim 1 wherein the container has an annular reinforcement of open-sided box construction extending radially outwards from the side wall and the ribs extend upwardly from the reinforcement, movement of the closure in the closing direction causing the ribs to be engaged by the opposing surface which is provided by the closure, the gaps being formed between the annular reinforcement and the closure.

4. An assembly according to claim 3 wherein the reinforcement comprises two annular spaced-apart flanges extending radially from the side wall and a plurality of axially extending walls which join the flanges together and which are spaced-apart circumferentially of the side wall, and the ribs extend upwardly from the uppermost annular flange.

5. An assembly according to claim 4 wherein each rib is located directly above an axially extending wall.

* * * * *